US008138403B1

(12) United States Patent
Kemp

(10) Patent No.: US 8,138,403 B1
(45) Date of Patent: Mar. 20, 2012

(54) BRACE FOR STRINGED INSTRUMENT

(76) Inventor: Christopher Clayton Kemp, Jacksonville, FL (US)

( * ) Notice: Subject to any disclaimer, the term of this patent is extended or adjusted under 35 U.S.C. 154(b) by 108 days.

(21) Appl. No.: 12/775,356

(22) Filed: Jul. 19, 2010

(51) Int. Cl.
*G10D 3/00* (2006.01)

(52) U.S. Cl. ..... 84/291; 84/267

(58) Field of Classification Search ..... 84/267, 84/291

See application file for complete search history.

(56) References Cited

U.S. PATENT DOCUMENTS

| | | | | | |
|---|---|---|---|---|---|
| 738,811 | A * | 9/1903 | Johnson | 84/268 |
| 2,020,557 | A * | 11/1935 | Loar | 84/726 |
| 3,302,507 | A * | 2/1967 | Fender | 84/267 |
| 3,892,159 | A | 7/1975 | Houtsma | |
| 4,026,181 | A * | 5/1977 | Barcus et al. | 84/291 |
| 4,206,678 | A * | 6/1980 | Espinos Guerrero | 84/267 |
| 4,253,371 | A * | 3/1981 | Guice | 84/267 |
| 4,741,238 | A * | 5/1988 | Carriveau | 84/291 |
| 4,930,389 | A * | 6/1990 | Kunstadt | 84/293 |
| 5,260,505 | A * | 11/1993 | Kendall | 84/298 |
| 5,410,936 | A * | 5/1995 | Ellsworth et al. | 84/298 |
| 5,549,027 | A * | 8/1996 | Steinberger et al. | 84/297 R |
| 5,661,252 | A * | 8/1997 | Krawczak | 84/291 |
| 5,679,910 | A * | 10/1997 | Steinberger et al. | 84/291 |
| 5,739,444 | A * | 4/1998 | Borisoff | 84/291 |
| 5,922,979 | A * | 7/1999 | Yui | 84/291 |
| 6,459,024 | B1 * | 10/2002 | Baker | 84/291 |
| 6,603,066 | B2 * | 8/2003 | Rogers | 84/298 |
| 6,646,191 | B1 | 11/2003 | Martin | |
| 7,115,803 | B2 * | 10/2006 | Machida | 84/294 |
| 7,446,247 | B2 * | 11/2008 | Shellhammer | 84/291 |
| 7,462,767 | B1 * | 12/2008 | Swift | 84/291 |
| 8,008,558 | B2 * | 8/2011 | Koentopp | 84/291 |
| 2007/0234872 | A1 * | 10/2007 | Cody | 84/291 |
| 2008/0053288 | A1 * | 3/2008 | Brunkalla | 84/267 |
| 2008/0190263 | A1 * | 8/2008 | Drew | 84/291 |
| 2008/0202310 | A1 * | 8/2008 | Coke | 84/291 |
| 2011/0179937 | A1 * | 7/2011 | Miloslavsky | 84/291 |

* cited by examiner

*Primary Examiner* — Elvin G Enad
*Assistant Examiner* — Robert W Horn
(74) *Attorney, Agent, or Firm* — Jo-Anne Yau; Yau Law Firm

(57) ABSTRACT

A new and improved body and bridge bracing system for stringed musical instruments includes an bracing system that consists of an upper brace located in the upper body of the instrument's body and a lower brace located in the lower body. Two or more longitudinal braces connect to each of the lateral braces and provide the instrument's neck, body, and soundboard support against the constant stress of the strings. A bridge reinforcing means is also included and consists of two or more truss rods. The rods connect the upper body lateral brace to the bridge area and further counteract the tension of the strings thereby preventing damage to the bridge and soundboard.

8 Claims, 10 Drawing Sheets

BRACE FOR STRINGED INSTRUMENT

CROSS-REFERENCE TO RELATED APPLICATIONS

Not applicable.

FEDERALLY SPONSORED RESEARCH

Not applicable.

SEQUENCE LISTING OR PROGRAM

Not applicable.

FIELD OF THE INVENTION

This invention relates generally to the field of stringed musical instruments, such as guitars. Specifically, this invention relates to a bracing system to support the body and bridge of the stringed musical instrument, to prevent warping of the soundboard due to tensile forces exerted upon it by its strings.

BACKGROUND OF THE INVENTION

The basic components of an acoustic stringed instrument are a soundboard, a hollow body, strings, a neck along which a plurality of strings run parallel, and anchor points for the strings. The anchor points are found at the head of the neck and at the bridge, which is anchored to the soundboard. Strings are secured to the outer surface of a soundboard by means of a bridge. Stringed instruments have been designed and constructed with a soundboard to amplify or enhance the sound produced from the vibration of the strings as the instrument is played. This is best exemplified in acoustic guitars. To play the instrument, the strings are tapped, picked, or plucked. These actions transfer sound vibrations through the bridge to the soundboard. In general, the soundboard features a round hole cut through it, to better transmit sound. The soundboard is critical, because changes to the soundboard affects sound production, tone, quality, volume, and amplification.

Structurally, the soundboard provides shape to the instrument. The instrument's neck, sides, and sound box must consider the shape of the soundboard, and conform therewith. Furthermore, the soundboard securely anchors the bridge and strings. Optimally, soundboards are lightweight, flexible, and durable. Therefore, any reinforcement or bracing that exerts unnecessary pressure on the soundboard will inhibit its ability to respond to the vibration of the strings. This same undesired effect results if the reinforcement or bracing makes unnecessary contact with the soundboard. This effect is analogous to touching the cone of a vibrating stereo speaker. As pressure or contact with the vibrating cone increases, volume output and sound quality decreases.

The desired characteristics of an effective soundboard are in direct opposition with the demands placed upon it. For centuries, luthiers have been faced with a dilemma: the lightweight and flexible qualities desired of a soundboard are not conducive to withstanding the tensile forces of a guitar's strings, particularly over a long period of time. This dilemma is compounded by the constant demand for a durable, yet esthetically pleasing guitar. Over the years, acoustic guitar design has been a delicate compromise between structural integrity and sound quality. Without a counteracting force, such tension would cause total failure of the instrument as the soundboard structure warped under the pressure. Specifically, the static string tension pulls the neck toward the body, pries the bridge from the soundboard, or collapses the body altogether. Distortion of the instrument eventually leads to undesirable sound quality, and repairs can be expensive.

Accordingly, there is a need for an invention that provides sufficient strength to support the soundboard of a stringed instrument, while still allowing for superior sound production and aesthetic beauty. This support is best effectuated through counteracting the force of the strings. Also, it is important for a stringed instrument to be aesthetically pleasing as they are often used for exhibition and entertainment purposes.

Numerous inventions have attempted to remedy these concerns. The stringed musical instrument balancer in U.S. Pat. No. 7,462,767 to Swift includes a bracket attached underneath the bridge and an adjustable brace attached to the block, stabilizing the neck inside the body cavity of the stringed musical instrument. The bracket and brace are connected by a non-elastic string to offset the torque exerted by the instrument's strings. Due to its low mass and minimal contact with the soundboard, the invention does not greatly impact the sound quality of the instrument. However, the present invention advantageously departs from Swift by providing overall support to the entire instrument and not merely to the soundboard and bridge. Furthermore, Swift's single non-elastic string runs down the center of the guitar body cavity, making it visible through the sound hole of the instrument. This characteristic thereby detracts from the aesthetic quality of the guitar itself.

This same compromise in the guitar's appearance is evident in devices similar to those U.S. patent application Ser. No. 11/706,514 to Drew.

Some inventions have attempted to hide the bracing from view. For example, the U.S. Patent to Shellhammer (U.S. Pat. No. 7,446,247) anchors its bracing system to the soundboard. This design, however, still compromises the soundboard structure, because the forces upon the anchor points are still transmitted to the soundboard itself. The present invention substantially departs from the shortcomings in Shellhammer, because the brace anchor points are to the neck block and tail block, not just to the soundboard and bridge. Thus, the present invention can better support the soundboard by depending on the structural strength of the guitar body as a whole.

The ability to freely vibrate is a critical characteristic for a soundboard. Although many devices in the past have sought to reinforce the structural integrity of the soundboard, they also hinder its ability to vibrate. Such is the case in devices like the guitar body reinforcement in U.S. Pat. No. 7,439,427 to Kroeger et. al. While it discloses a system providing support for the soundboard, body, and neck of a stringed musical instrument by way of structures mounted onto the underside of the soundboard, inevitably, the sounds emanating from this soundboard will be muffled, because it does not allow the soundboard to freely vibrate. The present invention departs from this characteristic in the prior art in that it offers structural support while allowing superior sound volume and quality, because it does not make contact with the soundboard. This allows it to move freely, and transmit the cleanest, sharpest sound possible.

Some prior art has attempted to minimize contact with the soundboard altogether. For instance. U.S. Pat. No. 3,892,159 to Houtsma discloses a soundboard-bridge configuration for acoustic guitars wherein the only contact between the bracing members and the soundboard exists at the edge of the soundboard and beneath the bridge. Admittedly, the area of contact is much smaller than is seen in other prior art; nonetheless, the present invention still allows for the soundboard to vibrate even more, because it has no contact between the bracing members and the soundboard at all.

Hie present invention solves a number of other problems presented by the prior art. Despite the inefficiencies of the prior art, the Applicant has found no prior art devices that are designed to address the need to provide a bracing system for guitars to prevent warping of the soundboard under the tensile forces of the strings over a period of time, while preserving the crisp sound quality of a soundboard that can effectively vibrate.

Accordingly, there exists a need for a body and bridge bracing system, which can be used for stringed musical instruments. In this regard, the present invention substantially fulfills this need.

SUMMARY OF THE INVENTION

In light of the above stated background, the present invention is a new and improved bracing system for stringed musical instruments. The bracing system consists of an internal structural brace for the soundboard as well as a means for reinforcing the bridge. Specifically, the anchor points for this bracing system are along the inside walls of the stringed instrument's body, and the bridge. This bracing system does not make contact with the soundboard in any manner that would adversely affect sound quality. Efficiency, cost-effectiveness, sound quality, and aesthetics are always goals in the performing arts industry, and the present invention offers a unique device to achieve those goals.

Although this bracing system is intended for all stringed instruments, the preferred embodiment is a bracing system fitted into acoustic guitars.

The bracing system includes an upper brace abutting the neck block and a lower brace abutting the tail block, both braces having anchor points on the inner side of the body wall in their respective regions of the body. Longitudinal braces connect the upper and lower braces, and are arranged longitudinally along the inside of the body. These longitudinal braces assist in counteracting any twisting or buckling forces along that plane.

To further assist in counteracting longitudinal forces, a pair of rods are anchored to the upper brace and to the bridge plate. The bridge plate lays flush against the inner surface of the soundboard. The bridge plate counterpart is the bridge, and is found on the outer surface of the soundboard. The strings are anchored to the bridge, and thus exert forces upon the bridge when the strings are tightened. However, since the rods exert equal and opposite forces upon the bridge plate, the warping effect on the soundboard is thus cancelled.

Thus, the general features of the invention have been broadly outlined, such that the detailed description thereof that follows may be better understood. There are, of course, additional features of the invention that will be described, which will form the subject matter of the claims. It is to be noted that the invention is not limited to the details of construction, or to the arrangements of the elements set forth in the following description or representations in the figures. The invention is capable of other embodiments and of being used in a variety of ways for a multitude of purposes. Also, it is to be understood that the phraseology and terminology employed herein are for the purpose of description, and should not be regarded as limiting. Thus, the scope of the invention should be determined by the appended claims and their legal equivalents, and not by the examples given.

It is thus an object of this present invention to provide a new and improved bracing system for stringed instruments, which provides advantages over the prior art, while simultaneously overcoming the disadvantages of the prior art. Such improvements are specifically intended for, but not limited to stringed instruments in the guitar family.

It is another object of the present invention to optimize the balance desired of a soundboard: flexibility and durability. The present invention does not interfere with the soundboard's ability to vibrate, yet resists the forces that deteriorate the soundboard's structure.

It is yet another object of the present invention to provide enhanced sound output in stringed instruments. Enhanced sound output includes improved sound quality, volume, tone, and clarity.

Furthermore, it is yet another object of the present invention to provide a reduction in construction, labor, and repair costs for stringed instruments. This invention will provide a bracing system that is simple to manufacture, and thus incur lower costs of labor. Because the elements of the bracing system dispense with complex pieces and parts, it can be organically integrated into the conventional construction of stringed instruments. Furthermore, the bracing system prevents deterioration of the stringed instrument. Adding longevity prevents the need to seek repairs. Even when repairs are necessary, the damage is expected to be less significant, and thus less costly. With manufacture, labor, and repair costs are considered, this invention provides an economic advantage. Such an advantage can be passed to the consumer, thus making the invention more accessible to the public.

Another object of the present invention is to provide a versatile bracing system, such that alternative embodiments can easily be fitted with a broad range of stringed musical instruments of varying shapes, sizes, and designs.

It is yet another further object of the present invention to provide a body and bridge bracing system that is aesthetically pleasing, in that it can remain hidden from view.

It is an object of the present invention to provide a lightweight bracing system with a lifespan expected to at least equal that of the instrument in which it is installed.

These, together with other objects of the invention, along with the various features of novelty which characterize the invention, are pointed out with particularity in the claims, which are a part of this disclosure. For a better understanding of the invention, its operating advantages and the specific objects attained by its uses, reference should be made to the accompanying description and figures, in which there are illustrated preferred embodiments of the invention.

Further objects and advantages of this invention will become apparent from a consideration of the drawings and ensuing description While the above description contains many specificities, these should not be construed as limitations on the scope of the invention, but as exemplifications of the presently preferred embodiments thereof. Thus, the scope of the invention should be determined by the appended claims and their legal equivalents, and not by the examples given.

In view of the foregoing disadvantages inherent in the known types of bracing systems in the prior art, the present invention provides an improved body and bridge bracing system for stringed musical instruments. As such, the general purpose of the present invention, which will be described in greater detail, is to provide a new and improved body and bridge bracing system, which has all the advantages of the prior art, and none of the disadvantages.

DRAWINGS

Figures

The features and advantages of the present invention will be better understood and objects other than those set forth will become apparent when consideration is given to the following detailed description thereof. Such description makes reference to the drawings, wherein.

Figure 4:
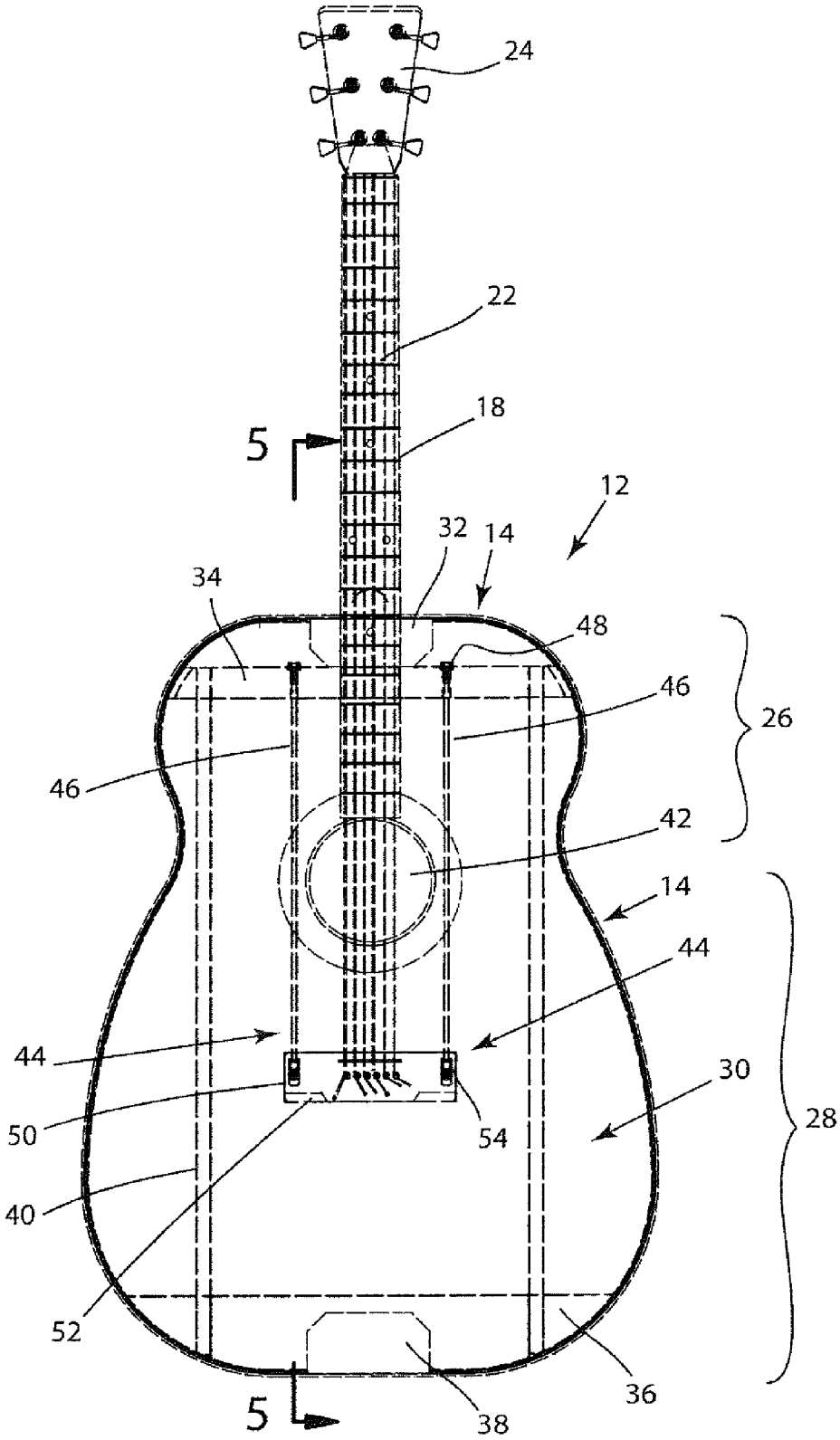

FIG. 4 and is a front view of an acoustic guitar. The phantom lines indicate the position of the bracing system within the body.

Figure 5:
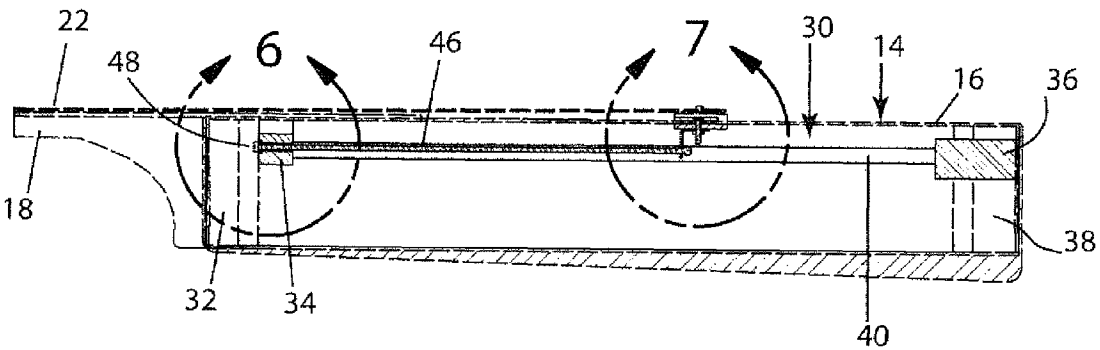

FIG. 5 is a longitudinal cross-sectional view of the body showing the body and bridge bracing system, taken along the line 5-5 in FIG. 4.

Figure 6:
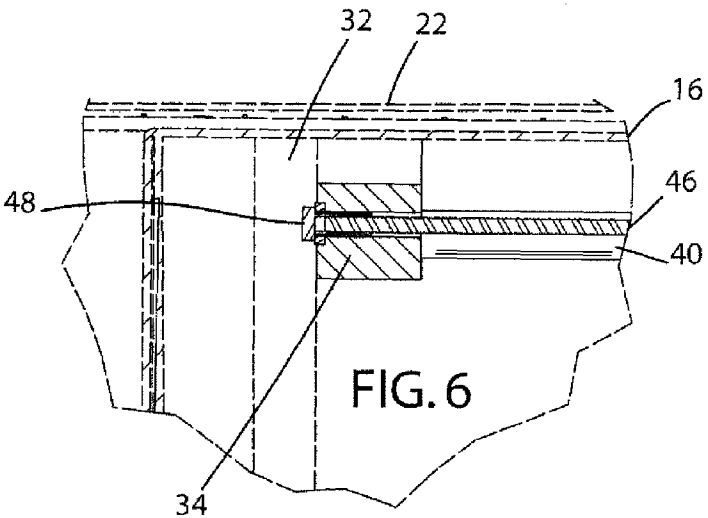

FIG. 6 is a partial view of the bridge bracing means, showing a rod as connected with the upper brace, encircled in FIG. 5.

Figure 7:
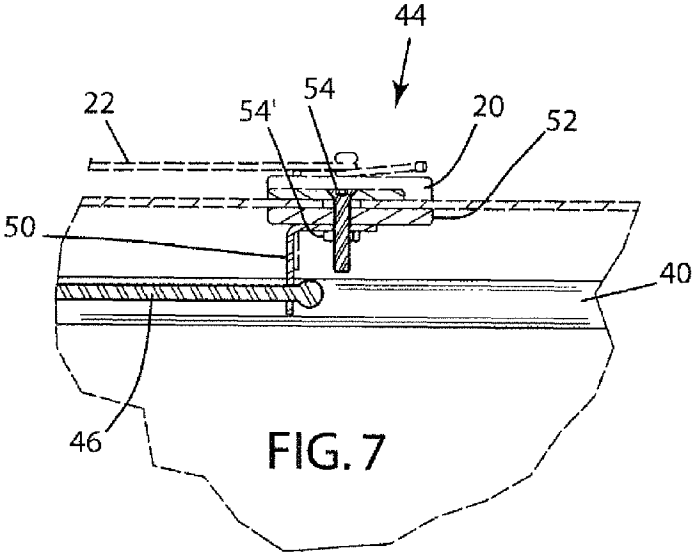

FIG. 7 is a partial view of the bridge bracing means, showing the rod as connected with the bridge plate, encircled in FIG. 5.

Figure 8:
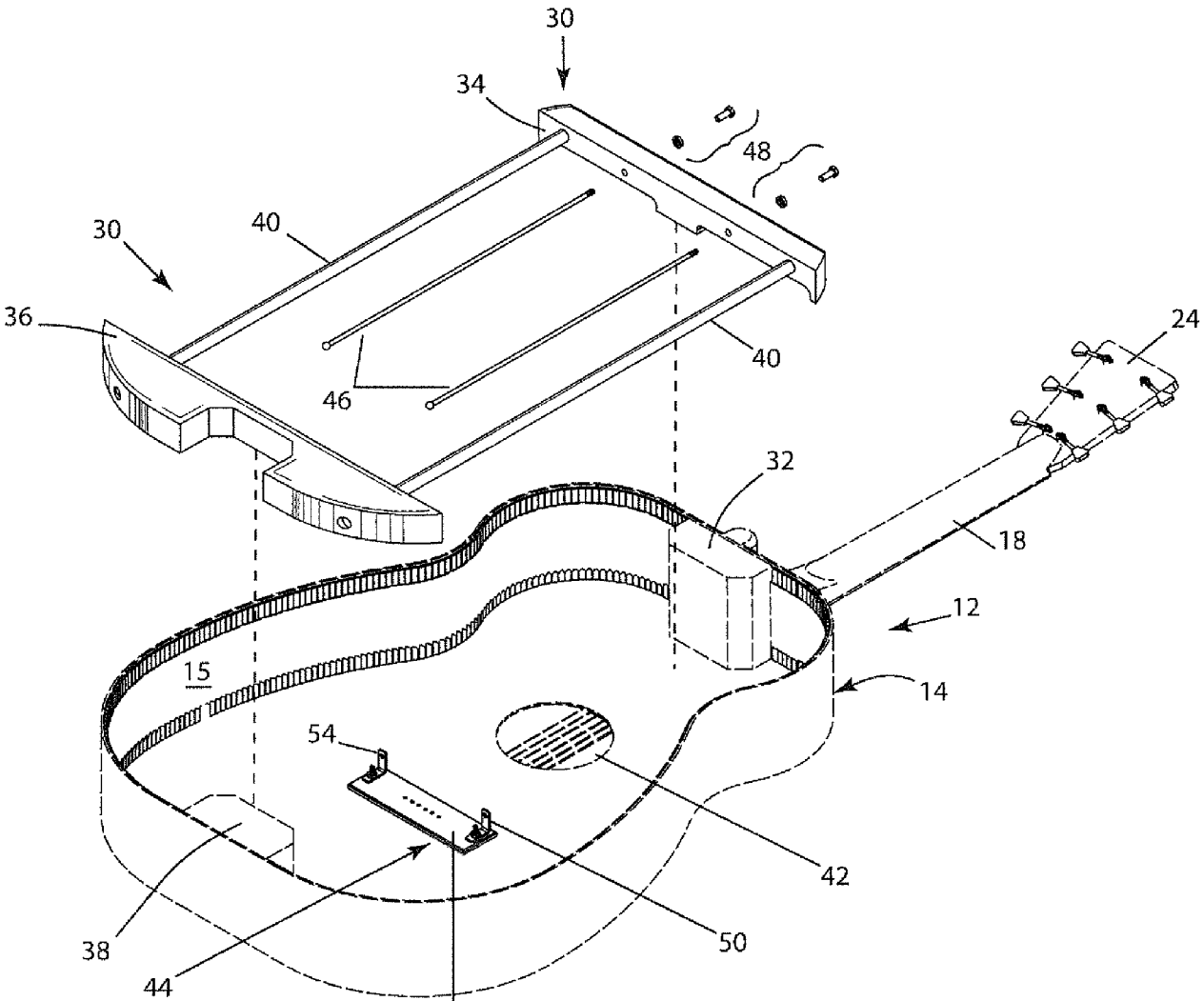

FIG. 8 is an exploded view of an acoustic guitar, revealing the manner in which the bracing system fits in the body.

Figures 9, 10:
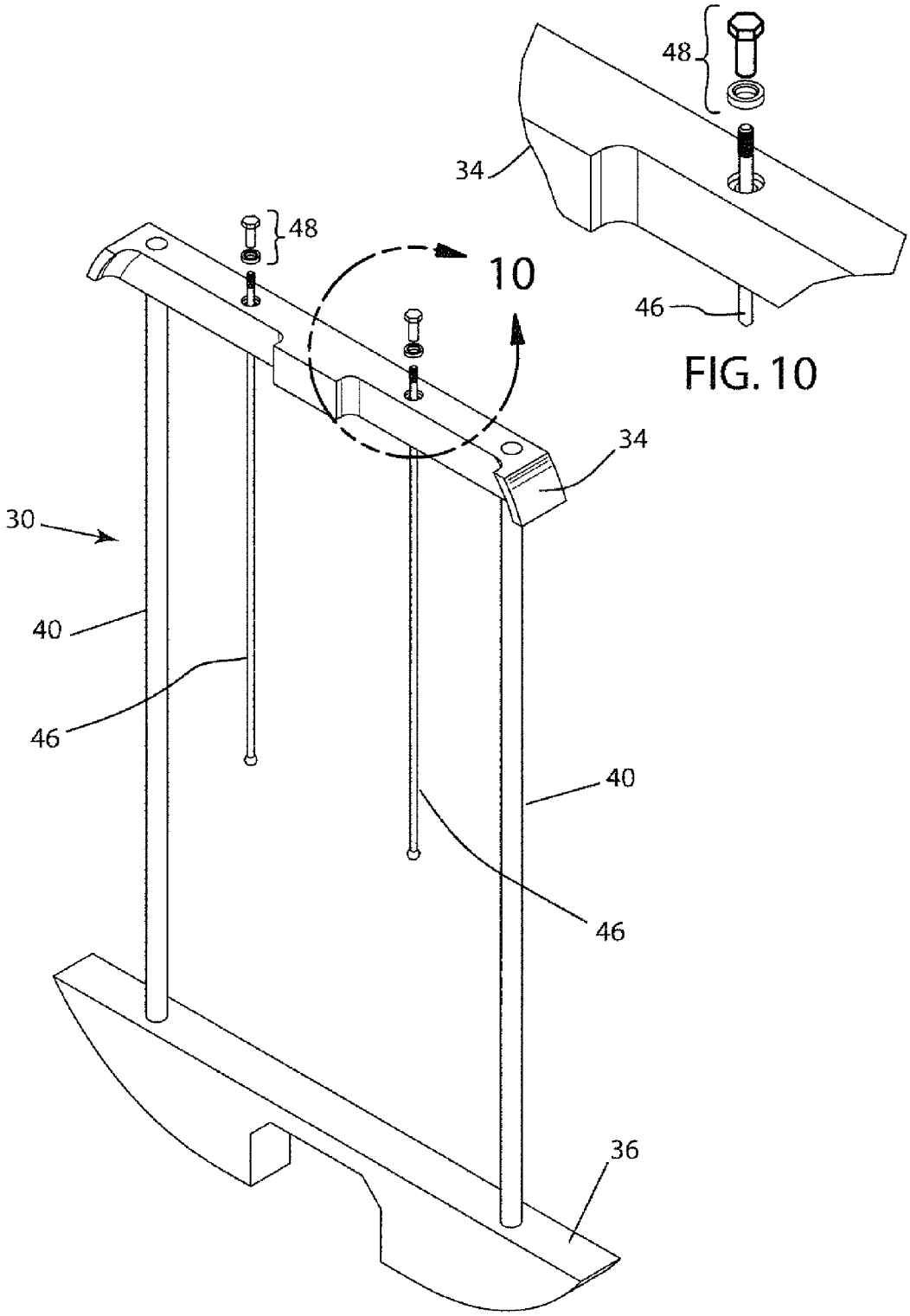

FIG. 9 is a perspective view of the bracing system.

FIG. 10 is a partial view of a rod as connected with the upper brace, encircled in FIG. 9.

Figure 11:
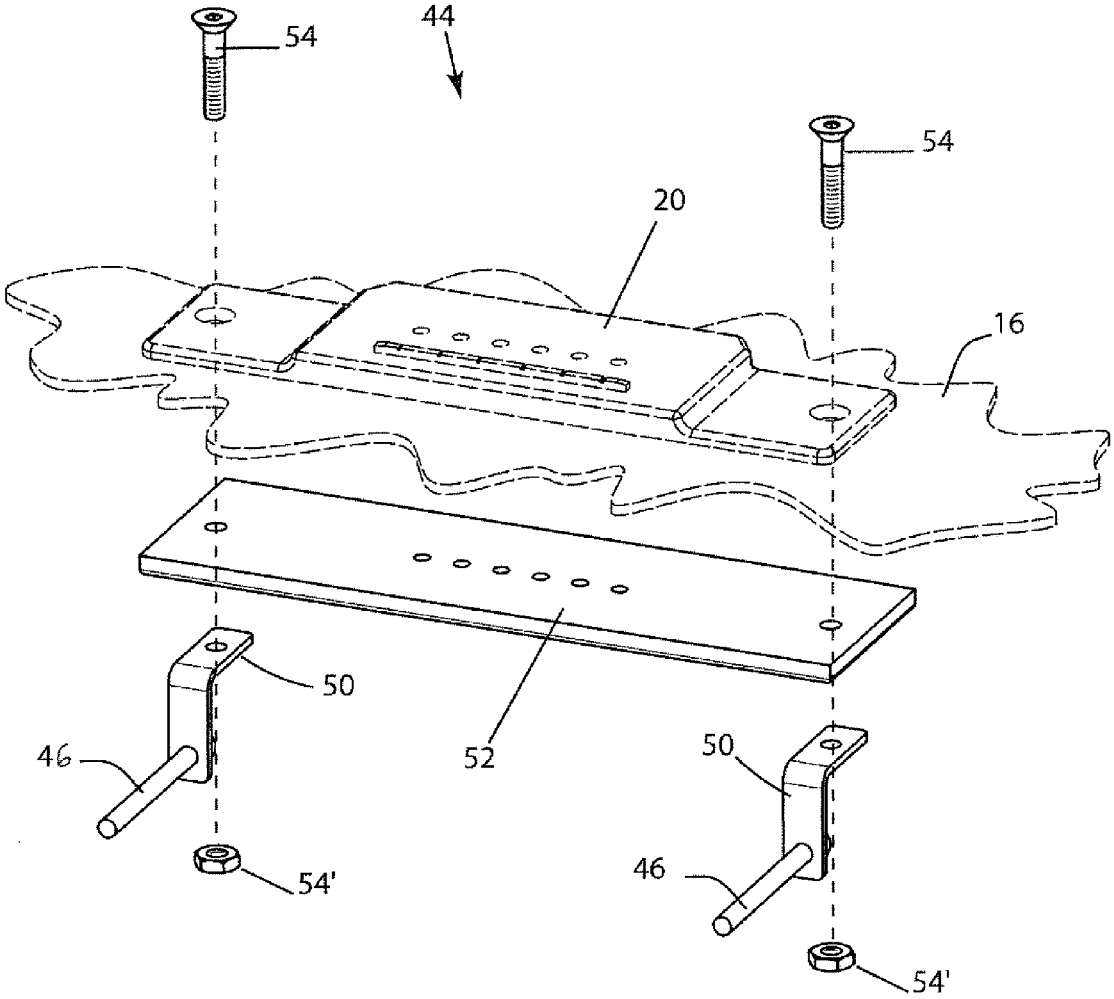

FIG. 11 is an exploded view of the bracing system as it connects to the bridge and bridge plate.

Figure 12:
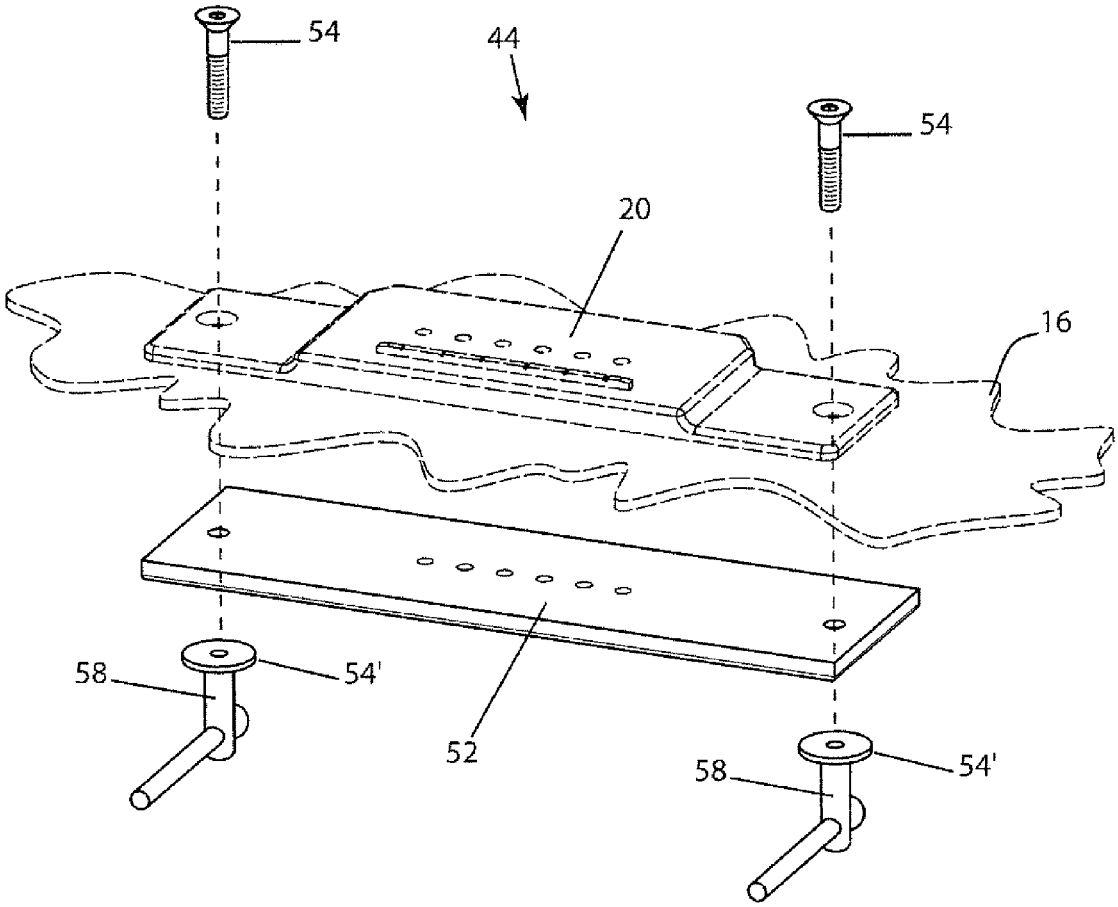

FIG. 12 is an exploded view showing an alternative embodiment of the bracing system as it connects to the bridge and bridge plate.

Figure 13:
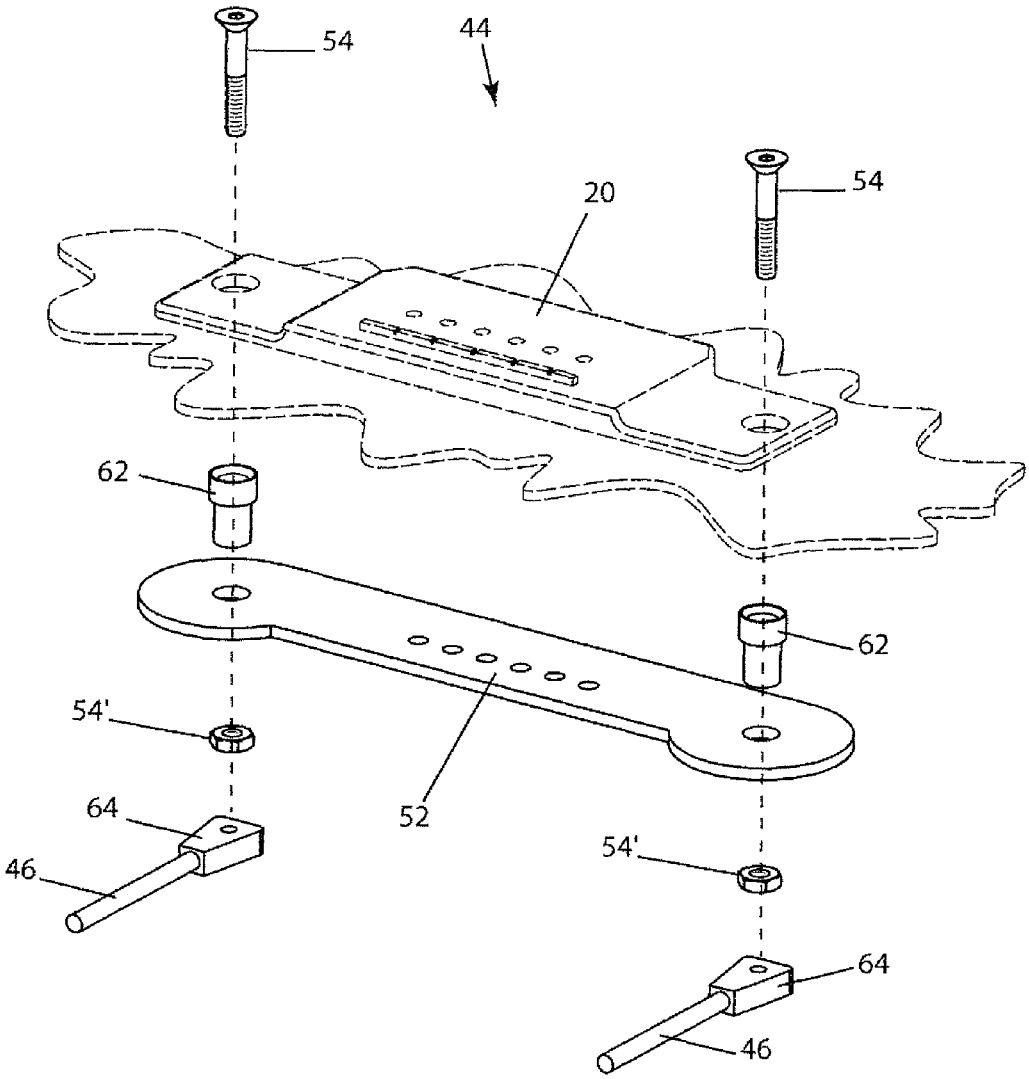

FIG. 13 is an enlarged exploded view showing another alternative embodiment of the bracing system as it connects to the bridge and bridge plate.

REFERENCE NUMERALS

12 Acoustic guitar
14 Body
15 Body wall
16 Soundboard
18 Neck
20 Bridge
22 Plurality of strings
24 Head
26 Upper body
28 Lower body
30 Bracing system
32 Neck block
34 Upper brace
36 Lower brace
38 Tail block
40 Longitudinal brace
42 Sound hole
44 Means for reinforcing the bridge
46 Rods
48 Rod-securing means
50 Bracket
52 Bridge plate
54 & 54' Bridge fasteners
58 Tubular brackets
62 Spacer
64 Rod end modification

DETAILED DESCRIPTION OF THE INVENTION

With reference now to the drawings, and in particular, FIGS. 1-13, for a new and improved bracing system for stringed musical instruments, the principles and concepts of the present invention will be described.

The present invention is comprised of a plurality of components. Stated broadly, such components include an internal structural means for bracing the soundboard, which further comprises lateral and longitudinal braces and rods. As explained below, alternative embodiments may exist, depending on the configuration of the musical instrument. The elements of the invention work together in such a manner as to synergistically attain the desired objectives.

Referring to FIGS. 1-4, the claimed invention is for a stringed instrument such as an acoustic guitar 12. The main components of a standard acoustic guitar 12 include: a body 14, a body wall 15, a soundboard 16, a neck 18, a bridge 20 anchoring a plurality of strings 22 that are attached to the head 24. The body 14 generally has a smaller, anterior upper body 26 segment and a larger, posterior lower body 28 segment. The bridge 20 is preferably attached to the soundboard 16. A plurality of strings 22 are anchored to the bridge 20, and are arranged longitudinally up the body 14, typically over a sound hole 42, parallel to the neck 18, and attach at the head 24.

Referring to FIGS. 2-9, the bracing system 30 for the body 14 and the soundboard may be comprised of an upper brace 34, a lower brace 36, and a longitudinal brace 40. Most modern stringed instruments have a neck block 32 for attaching the neck 18 to the body 14 in the upper body 26 area. In guitars 12 that do not have a neck block 32 to attach the neck 18 to the body 14, a portion of the neck 18 may protrude into the body 14 of the instrument. Regardless, the present invention can be used with either configuration.

Figure 1:
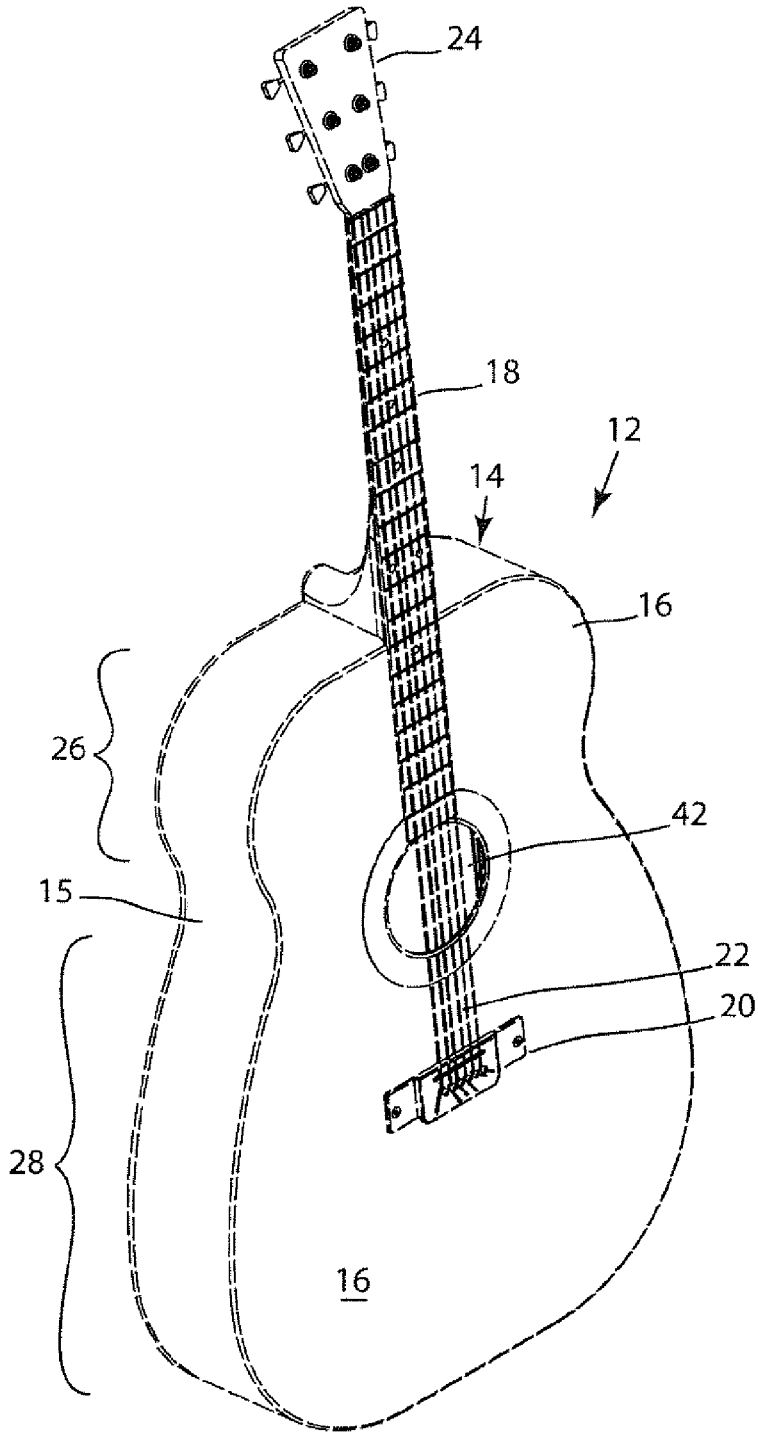
FIG. 1 is a perspective view of the front of a stringed musical instrument; specifically, an acoustic guitar.
Figure 2:
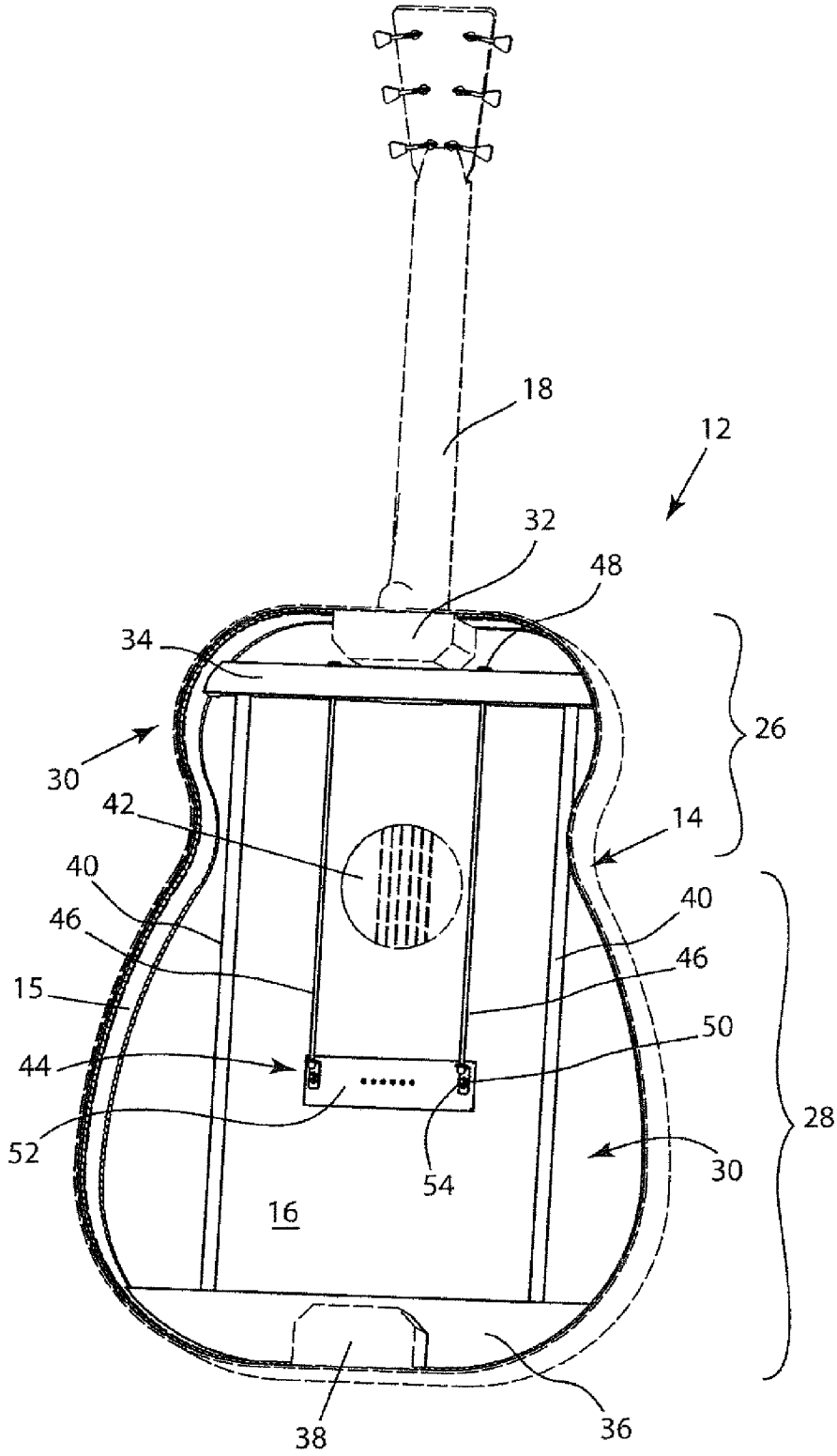
FIG. 2 is a perspective view of the back of an acoustic guitar, revealing the inside of the body.

Referring to FIG. 2, an upper brace 34 is placed inside the body 14 of the stringed musical instrument in the upper body 26. When a neck block 32 is present, the upper brace 34 is placed inside the body 14 and is attached to the neck block 32, and affixed the body wall 15 on each side of body 14 in the upper body 26. Even without a neck block 32, the upper brace 34 is placed inside the body 14 in a similar fashion and serves the same purpose in reinforcing the neck joint. In either configuration, the upper brace 34 does not come into contact with the soundboard 16. This advantageously allows the soundboard 16 to freely vibrate, producing a high quality and volume of sound.

Figure 3:
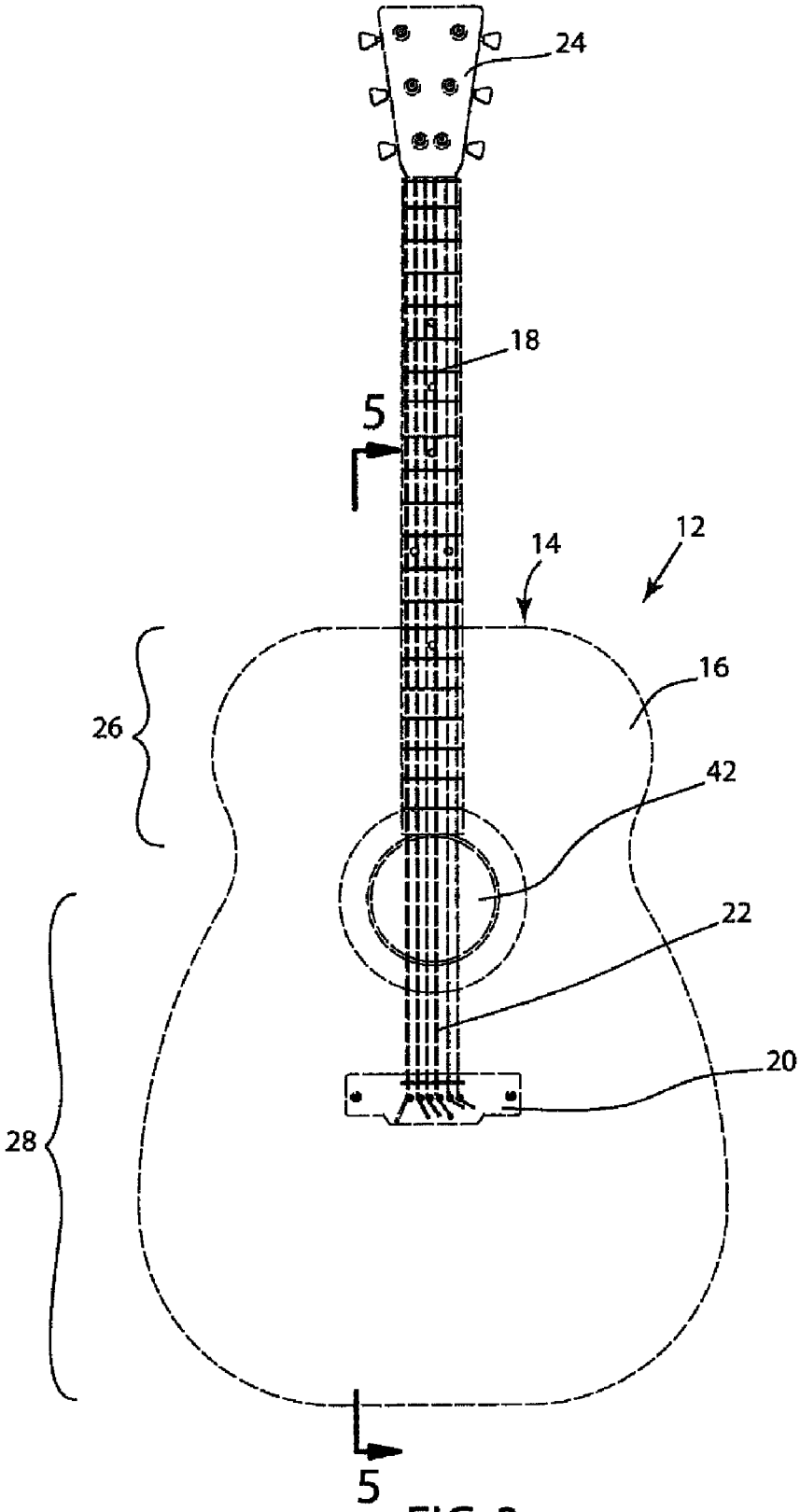
FIG. 3 is a front view of an acoustic guitar.

The bracing system 30 also includes a lower brace 36 situated inside the body 14 in the lower body 28 area. If the posterior end of the body 14 features a tail block 38, the lower brace 36 can be affixed to the body wall 15 in such a manner as to accommodate the tail block 38, or alternatively, be affixed to the body wall 15 in the lower body 28 area, independent of the tail block 38. FIGS. 2 and 3 demonstrate the lower brace 36 incorporated with the tail block 38.

The means to affix the upper brace 34 or the lower brace 36 to the body wall 15 can be temporary or permanent, and can include, but not be limited to the use of glue, screws, bolts, or staples. Furthermore, the upper brace 34 and the lower brace 36 can be tailored and fit so snugly against the body wall 15 that friction alone can hold them in place.

Alternatively, the bracing system 30 does not have to rely on a lower brace 36 in the lower body 28 area. For stringed instruments that have a tail block 38, the tail block 38 could serve as a lower brace 36. Similarly to the upper brace 34 in the upper body area, the lower brace 36 in the lower body 28 does not come into contact with the soundboard.

Referring again to FIGS. 2-9, the bracing system 30 also includes two longitudinal braces 40 installed on both sides of the body 14. These longitudinal braces 40 run parallel to the centerline of the guitar 12. The longitudinal braces 40 join and connect the upper brace 34 to the lower brace 36. When installed in this manner, this new bracing system will have a somewhat square box shape, but is not limited to this shape. For instance, in embodiments wherein the tail block 38 operates as a lower brace, the longitudinal braces 40 could be designed to form a V-shaped bracing system. The possible configurations of this device are advantageous in conventional stringed instruments because the longitudinal braces 40 are not seen through the sound hole 42 and therefore do not detract from the aesthetic quality of the instrument.

As the tension from the plurality of strings 22 pull on the soundboard 16 and the neck 18, the lower body 28 and upper body 26 are pulled toward each other. The longitudinal braces 40 reinforce the lower body 28 and upper body 26, preventing buckling. The longitudinal braces 40 effectively counteract the tension caused by the strings 22, thereby preventing the instrument from warping or collapsing. The added strength does not inhibit the instrument's quality or volume of sound because the longitudinal braces 40, upper braces 34, and lower braces 36 do not touch the active part of the soundboard 16. Thus, the soundboard 16 can freely vibrate in response to the instrument's strings 22 being plucked or strummed.

Alternatively, this design does not have to rely on a lower brace 36 in the lower body 28. In an alternate embodiment both longitudinal braces 40 may run from the upper brace 34 in the upper body 26 to a point where the tail block 38 is located, thus forming a V-shaped frame. This V-shaped frame could be used with or without a tail block 38.

All of the braces in this bracing system 30 can be made from any type of wood, man-made, or composite material. The cross sectional shape of the bracing system 30 can be of any shape deemed necessary to resist the tension or stress that is generated from the strings 22.

Referring now to FIGS. 2-13, the means for reinforcing the bridge 44 is preferably comprised of components that maintain the structural integrity of the bridge 20 and soundboard 16. Conventional stringed musical instruments with a body 14, soundboard 16, and neck 18 also include a bridge 20 attached to the soundboard 16, and strings 22 anchored to the bridge 20. The strings 22 are anchored in such a manner that they are pulled tight, creating tension. The tension generated by the strings 22 causes a torsional effect on the bridge 20. Over time, this tension can cause the bridge 20 to become dislodged or may warp the soundboard 16 of the instrument. By running rods 46 parallel to the stresses on the soundboard 16 and applying an equal and opposite force by attaching one end to the area of the bridge 20 and then anchoring the other end to an upper brace 34, this torsional effect can be significantly reduced.

Referring to FIGS. 2 and 4, two rods 46 may be arranged according to aesthetic needs. In the conventional design of modern stringed instruments having a single sound hole 42 placed in the center of the soundboard 16, the rods 46 will not be visible through the sound hole 44, as arranged in the preferred embodiment. This is beneficial because the sight of extra hardware though an instrument's sound hole 44 may detract from its overall visual appeal.

Referring to FIGS. 2-10, the rods 46 can be made of a metal steel alloy or composite material strong enough to withstand the tension that is generated by the strings without yielding. The rods 46 are anchored at one end and adjustable at the other. As seen in FIGS. 9 and 10, the rods 46 attach to the upper brace 34 in with rod-securing means 48, and are tensioned to counteract the torsional effect of the strings 22 that are placed on the bridge 20 and soundboard 16. The rod-securing means 48 are preferably screws and nuts or bolts, which can be optionally tightened or loosened. A bridge plate 52 on the underside of the soundboard 16 directly opposite from the bridge 20 is where the rods 46 anchor. A bracket 50 allows for improved leverage, and the bracket 50 attaches to the bridge plate 52 with bridge fasteners 54, 54', which are preferably screws and nuts or bolts.

While the rods 46 may be anchored to the upper brace 34 in the preferred embodiment, in alternative embodiments, they may be anchored elsewhere near the neck 18, so as to pull on the bridge with an equal force to counteract the torsional effect placed on the bridge 20 from the tension of the strings 22.

In the preferred embodiment, the means for reinforcing the bridge 44 would be as seen in FIG. 11. The preferred embodiment includes the bridge plate 52 securely mounted to the underside of the soundboard 16, directly opposite the bridge 20, which is on the outer side of the soundboard 16. Brackets 50 are mounted to the bridge plate 52. Bridge fasteners 54, 54' fasten the bridge 20, sound board 16, bridge plate 52, and brackets 50 together. The brackets 50 are also connected to the rods 46 in a manner that is readily known to those ordinarily skilled in the art. The brackets 50 in the preferred embodiment are L-shaped, but any shape will suffice, as long as the brackets 50 provide leverage between the rods 46 and the bridge 20. Furthermore, although the brackets 50 in the preferred embodiment are two separate pieces, they may be incorporated into one solid piece in alternative embodiments. Alternatively, the brackets 50 may have alternative configurations, as long as they achieve the goal of providing leverage once attached to the rods 46 and the bridge 20. This leverage is essential to counteract the forces exerted on the bridge 20 from the tension of the strings 22, which causes the soundboard 16 to roll, bend, warp, or otherwise lose its original form. In essence, the brackets 50 and rods 46 counteract the tensile stress of the strings 22 above the soundboard 16 by supplying an equal pulling force beneath the soundboard 16.

FIG. 12 illustrates an alternative embodiment of the means to reinforce the bridge 44. In particular, this embodiment modifies the bridge fasteners 54, 54' by using tubular brackets 58 rather than the conventional bracket 50 seen in FIG. 11. The advantage of the tubular bracket 58 is that can be integrated as a part of the bridge fasteners 54, rather than being a separate, independent element. Because the tubular brackets 58 are secured to the bridge plate 52 by direct attachment to the bridge fasteners 54, this alleviates the need for extra parts. The tubular brackets 58 are similarly connected to the rods 46 so as to provide leverage between the rods 46 and the bridge 20.

FIG. 13 illustrates another alternative embodiment, involving the means of reinforcing the bridge 44. This design features spacers 62 that separate the bridge plate 52 from the underside of the bridge 20. The spacers 62 provide the necessary leverage to counteract the forces upon the bridge 20 imposed by the strings 22. Each rod 46 is fastened directly to the bridge plate 60, spacer 62, soundboard 16, and bridge 20 with bridge fasteners 54, 54'. In this configuration, the end of the rods 46 will need to be modified 64 to receive the bridge fasteners 54, 54'.

As to the manner and usage of the present invention, the same should be apparent from the above description.

With respect to the above description, it is to be realized that, to achieve the optimum relationships for the parts, consideration must be made to variations in size and dimension, materials, shape, form, function, and the manner of operation, assembly, and use. Such considerations are intended to be encompassed by the present invention, and will be readily apparent and obvious to one skilled in the art. All suitable modifications, adaptations, and equivalents may be resorted to, falling within the scope of the invention. Although some embodiments have been illustrated in the accompanying drawings and described in the foregoing detailed description, it will be understood that the intention is not limited to the embodiments discussed, but is capable of numerous rearrangements, modifications, and substitutions without departing from the spirit and scope of the invention. Other changes, and uses within the scope of the invention, as defined by the appended claims, will suggest themselves to those versed in the art. This application is intended to cover such departures from the present disclosure as those falling within known or customary practice in the art to which this invention pertains, and which falls within the limits of the appended claims.

This invention fully meets the objectives set forth.

The invention claimed is:

1. A bracing system for acoustic stringed instruments with a hollow body, a body wall, a sound board, a neck, a bridge and a bridge plate, the bridge and bridge plate placed on the top and bottom of the sound board, the bracing system comprising:

a. an upper brace near the neck affixed to the inner body wall of the stringed instrument;

b. a lower brace affixed to the inner body wall near the tail end of the body;

c. two or more longitudinal braces, one end of which is attached to the upper brace, and the other end attached to the lower brace;

d. a means for reinforcing the bridge that provides leverage against the instrument's bridge plate, which acts to counteract the direction of force exerted by the instrument's strings on the bridge; and e. two or more rods, one end of which is inserted into the upper brace, and the other end inserted into the means for reinforcing the bridge, in a manner such that the rods sufficiently withstand and counteract the direction of force exerted by the instrument's strings on the bridge.

2. The bracing system as claimed in claim 1, wherein said means for reinforcing the bridge uses an L-shaped bracket.

3. The bracing system as claimed in claim 1, wherein said means for reinforcing the bridge uses a tubular bracket.

4. The bracing system as claimed in claim 1, wherein said means for reinforcing the bridge uses a spacer between the sound board and the bridge plate.

5. A bracing system for acoustic stringed instruments with a hollow body, a body wall, a sound board, a neck, a bridge and a bridge plate, the bridge and bridge plate placed on the top and bottom of the sound board, the bracing system comprising:

a. an upper brace and a lower brace, arranged parallel to one another and perpendicular to the longitudinal centerline of the body, and affixed to the inner body wall of the stringed instrument;

b. two or more longitudinal braces, one end of which is attached to the upper brace, and the other end attached to the lower brace;

c. a means for reinforcing the bridge that provides leverage against the instrument's bridge plate, which acts to counteract the direction of force exerted by the instrument's strings on the bridge; and d. two or more rods, one end of which is inserted into the upper brace, and the other end inserted into the means for reinforcing the bridge, in a manner such that the rods sufficiently withstand and counteract the direction of force exerted by the instrument's strings on the bridge.

6. The bracing system as claimed in claim 5, wherein said means for reinforcing the bridge uses an L-shaped bracket.

7. The bracing system as claimed in claim 5, wherein said means for reinforcing the bridge uses a tubular bracket.

8. The bracing system as claimed in claim 5, wherein said means for reinforcing the bridge uses a spacer, located between the sound board and the bridge plate.

* * * * *